US005828271A

United States Patent [19]

Stitzer

[11] Patent Number: 5,828,271

[45] Date of Patent: Oct. 27, 1998

[54] PLANAR FERRITE TOROID MICROWAVE PHASE SHIFTER

[75] Inventor: Steven N. Stitzer, Ellicott City, Md.

[73] Assignee: Northrop Grumman Corporation, Los Angeles, Calif.

[21] Appl. No.: 811,793

[22] Filed: Mar. 6, 1997

[51] Int. Cl.[6] ..... H01P 1/32

[52] U.S. Cl. ..... 333/24.1; 333/158

[58] Field of Search ..... 353/24.1, 26, 156, 353/158, 248

[56] References Cited

U.S. PATENT DOCUMENTS

| | | | |
|---|---|---|---|
| 3,707,688 | 12/1972 | Robinson et al. | 333/24.1 |
| 3,761,845 | 9/1973 | Ajioka et al. | 333/248 X |
| 5,157,364 | 10/1992 | Pond et al. | 33/204 X |
| 5,170,138 | 12/1992 | Roberts et al. | 333/21.1 |
| 5,438,167 | 8/1995 | McClanahan et al. | 333/246 X |

FOREIGN PATENT DOCUMENTS

| | | | |
|---|---|---|---|
| 56-125101 | 10/1981 | Japan | 333/26 |

OTHER PUBLICATIONS

Charlton, "A Low–Cost Cosntruction . . . Phase shifters", IEEE trans. on microwave & Tech. vol., MTT–22, No. 6, pp. 614–617, Jun. 1974.

"Dual–Ferrite Slot Line for Broadband, High–Nonreciprocity Phase Shifters", *IEEE Transactions On Microwave Theory And Techniques,* vol. 39, No. 12, Dec., 1991, pp. 2204–2210.

*Primary Examiner*—Robert J. Pascal
*Assistant Examiner*—Seungsook Ham
*Attorney, Agent, or Firm*—Walter G. Sutcliff

[57] ABSTRACT

A planar phase shifter having plural layers of ferrite forming a closed magnetic toroidal path and including internal layers of dielectric material of a relatively high dielectric constant and underlying layers of dielectric material having a relatively low dielectric constant. A stripline to slot line transition is also formed at least at one end of the device. All of the elements are formed over a ground plane and have either metallized external sidewalls or a set of metallized vias running through the outer wall portions over its length.

20 Claims, 5 Drawing Sheets

PLANAR FERRITE TOROID MICROWAVE PHASE SHIFTER

CROSS REFERENCE TO RELATED APPLICATION

This invention is related to the inventions shown in related application U.S. Ser. No. 08/511,927 (BD 95-143), entitled, "Planar Phase Shifters Using Low Coercive Force And Fast Switching, Multilayerable Ferrite", filed in the names of John D. Adam et al on Aug. 7, 1995, and in U.S. Ser. No. 08/211,792 (BD-95-189), entitled, "Stripline Transition For Twin Toroid Phase Shifters", filed in the name of Steven Stitzer on Mar. 6, 1997. These related applications are assigned to the assignee of the present invention and are intended to be specifically incorporated herein by reference.

BACKGROUND OF THE INVENTION

1. Field of the Invention

This invention relates generally to devices used to modify the phase of a microwave signal and more particularly to planar ferrite phase shifters.

2. Description of Related Art

Phase shifters are devices in which the phase of an electromagnetic wave of a given frequency propagating through a transmission line can be shifted. Such devices have been extensively used in radar applications for electronic beam steering and phased array applications. Two types of electronic phase shifters are currently utilized for modern phased array antenna systems, namely: ferrite phase shifters and solid state semiconductor phase shifters. Ferrite phase shifters generally fall into two categories: phase shifters enclosed within a waveguide structure and phase shifters built using transmission line microstrip configurations.

Toroid phase shifters are most commonly used because they have the lowest loss and highest power handling capability. Latching ferrite phase shifters are set to a particular phase shift by a pulse of current so as to magnetize the ferrite. Moreover, the ferrite is typically fabricated in the form of a toroid whose closed magnetic path provides a latching action. This eliminates the need for a continuous control current. Either one or two toroids are placed within a rectangular waveguide as shown in FIGS. 1 and 2.

In FIG. 1, an elongated toroid of lithium ferrite, shown by reference numeral 10, and having a centralized bore 12 filled with dielectric material is centrally located within a section of rectangular waveguide 14. A magnetizing wire 15 also passes through the bore 11 for generating a magnetizing field M as shown. The space 16 and 18 on either side of the toroid 10 is open and constitutes an air space within the waveguide 14. In FIG. 2, two elongated ferrite toroid elements 20 and 22 are located within the waveguide 14 and are separated by a rib 24 of dielectric material having a relatively high dielectric constant $\epsilon_r$. The two toroid members 20 and 22, moreover, include centralized bores 26 and 28 which are filled with air and permit the passage of a magnetization wire 30 therethrough.

Only the two inner vertical walls of a ferrite toroid contribute significantly to the phase shift, the remaining walls serve only as magnetic return paths. For example, in the single toroid phase shifter shown in FIG. 1, walls 11 and 13 contribute to the phase shift, whereas the walls 21 and 23 contribute to the phase shift in the two toroid configurations shown in FIG. 2. In FIG. 2, the high dielectric constant $\epsilon_r$ rib 24 acts to concentrate the RF fields in the center of the waveguide as shown in FIG. 3.

The insertion phase is determined by the magnetization $4\pi M$ in the ferrite material caused by a current pulse fed through the wires 30 and 32 which threads through the toroids as shown in FIGS. 1 and 2. The magnetization $4\pi M$ can range from $-4\pi M_r$ to $+4\pi M_r$, where the remnant magnetization $4\pi M_r$ has a fixed value for a given ferrite. A differential phase shift increases with $4\pi M_r$ but it cannot exceed approximately $f_{min}$(MHz)/2.8 gauss to avoid high insertion loss.

It should be noted, however, that toroids are very expensive to fabricate. Ferrite is hard to machine, so the centralized bore or hole is usually formed by pressing ferrite powder around a rectangular mandrel. The mandrel is removed and the ferrite is fired at temperatures exceeding 1500° C. In the process, the part shrinks by as much as 20%. The outer walls are then diamond ground to fix the wall thickness. For Ku-band (12–18 GHz), the toroids are typically 0.125 in. square with 0.030 in. walls. The tolerances are usually tighter than ±0.001 in. on all dimensions, and must be maintained over the full length of the toroid which typically comprises about 1.3 in. at Ku-band. At the Ka-band (~35 GHz), these dimensions and their tolerances all reduce by a factor of about 2. Two toroids are then attached to the center rib or a single rib is fitted into the toroid hole for a single toroid design. The entire assembly is then metallized on all four outer walls of the toroid. Finally, a wire must be threaded through the hole. Accordingly, a complete Ku-band twin toroid phase shifter costs $200 or more.

Planar ferrite phase shifters have been known as early as 1991, for example, as taught in a publication entitled, "Dual-Ferrite Slot Line For Broadband, High-Non Reciprocity Phase Shifters", by E. El-Sharawy et al, IEEE Transactions On Microwave Theory And Techniques, Vol. 39, No. 12, December, 1991, pp. 2204–2210.

More recently, a planar stripline phase shifter has been disclosed in the above-related application Ser. No. 08/511,927, (BD-95-143). There a device is shown and described which is simply a ferrite-filled stripline, making it relatively inexpensive to fabricate. It is also reciprocal in that the differential phase shift is the same for RF propagating in both directions and has the advantage of not having to be switched between transmit and receive modes. However, a differential phase shift of only 75°/cm. can be achieved in the Ku-band for the highest usable $4\pi M$. The RESET (0 phase) condition is produced by sending a current through a center conductor so as to make the DC magnetization parallel to the RF magnetic field. The SET condition is produced by applying a longitudinal field which rotates the DC magnetization through an angle up to perpendicular to the RF magnetic field. The permeability is quadratic with magnetization, i.e. the direction of the magnetization is irrelevant, so only the change from 0 to $4\pi M_r$ ($4\pi M_r \sin 0°$ to $4\pi M_r \sin 90°$) is usable rather than the change from $-4\pi M_r$ to $+4\pi M_r$.

SUMMARY

Accordingly, it is an object of the present invention to provide an improvement in microwave phase shifters.

It is another object of the invention to provide an improvement in toroid microwave phase shifters.

It is still another object of the invention to provide an improvement in ferrite toroid microwave phase shifters.

Still another object of the invention is to provide an improvement in planar ferrite toroid microwave phase shifters which are magnetically latchable.

Briefly, the foregoing and other objects of the invention are achieved by a planar phase shifter comprising plural layers of ferrite forming a closed magnetic toroidal path including internal layers of dielectric material having a relatively high dielectric constant and underlying layers of dielectric material having a relatively low dielectric constant. A stripline to slot line transition is also formed at least at one end of the device, with all elements being formed over a ground plane and having either metallized external sidewalls or a set of metallized vias running through the outer wall portions over its length.

Further scope of applicability of the present invention will become apparent from the detailed description provided hereinafter. It should be understood, however, that the detailed description and specific examples, while disclosing preferred embodiments of the invention, are provided by way of illustration only, since various changes and modifications coming within the spirit and scope of the invention will become apparent to those skilled in the art from this detailed description.

BRIEF DESCRIPTION OF THE DRAWINGS

The present invention will become more fully understood when considered together with the accompanying drawings which are provided by way of illustration only, and thus are not limitative of the present invention, and wherein.

DETAILED DESCRIPTION OF THE INVENTION

Figure 1:
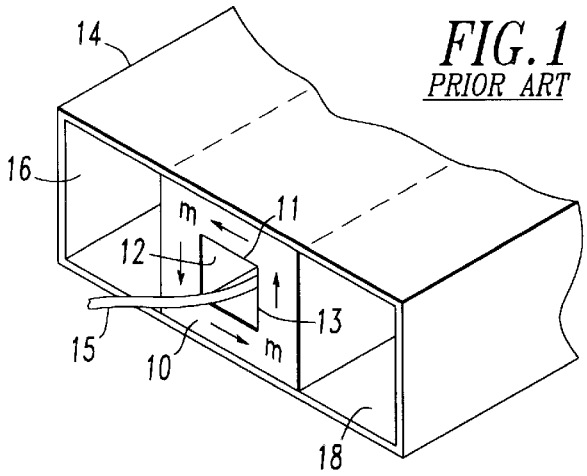
FIG. 1 PRIOR ART
FIG. 1 is a partial perspective view generally illustrative of a conventional single toroid microwave phase shifter.

Referring now to FIGS. 4A, 4B and 5A, 5B, depicted thereat is the evolution of the present invention and in some respects draws upon the structure taught by the E. El-Sharawy et al publication. In the configurations shown in FIG. 4A and 4B, which are typical of the known prior art, they disclose a single ferrite layer 34 being located between two layers of dielectric 36 and 38, the upper layer 36 having a relatively high dielectric constant, e.g. $\epsilon_r$=38 and the lower layer 38 having a relatively low dielectric constant, e.g. $\epsilon_r$=4. Slot lines 40 having a slot width W are located between the ferrite layer 34 and the underlying dielectric layer 38. The space 42 above the dielectric layer 36 is open and thus comprises an air space.

Figure 4A:
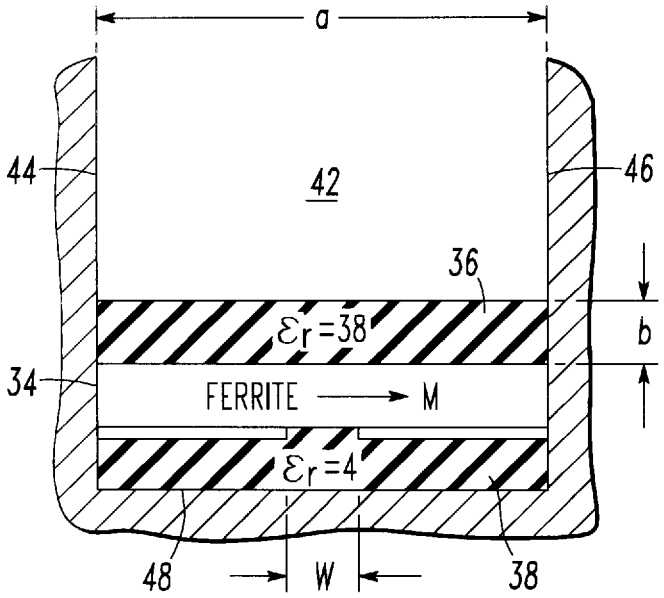
FIGS. 4A and 4B are transverse cross sectional views generally illustrative of a planar ferrite microwave phase shifter in accordance with the known prior art.
Figure 4B:
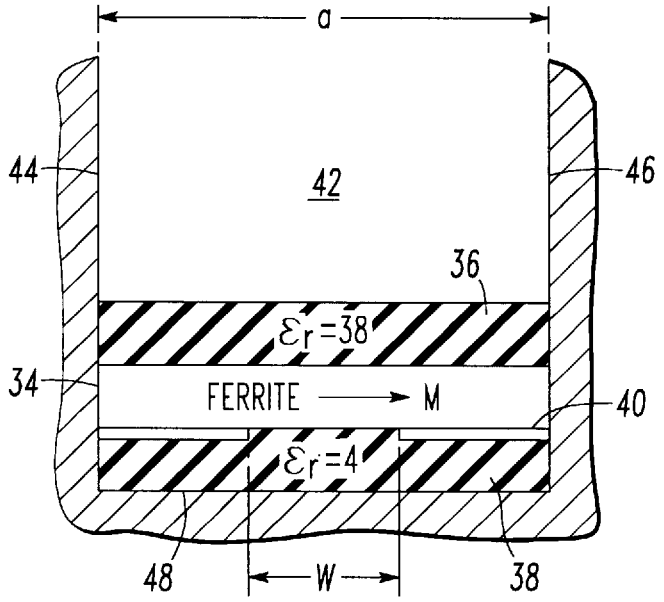

Typically, the width a of both structures are about 0.125 in., with the thicknesses b of the layers 34, 36 and 38 all being about 0.02 in. These layers, moreover, are located between a pair of metal walls 44 and 46 and a ground plane 48. The slot lines 40 propagate the RF signal applied to the device and couples an RF voltage to a transverse E-field. The wider the slot width w, the more phase shift will be produced. For example, for a relatively small slot such as shown in FIG. 4A, approximately 66°/cm. of phase shift can be produced at 16 GHz, whereas for a relatively wider slot as shown in FIG. 4B, a phase shift of approximately 98°/cm can be produced. It is to be noted, however, that such a configuration is not magnetically latchable.

Figure 5A:
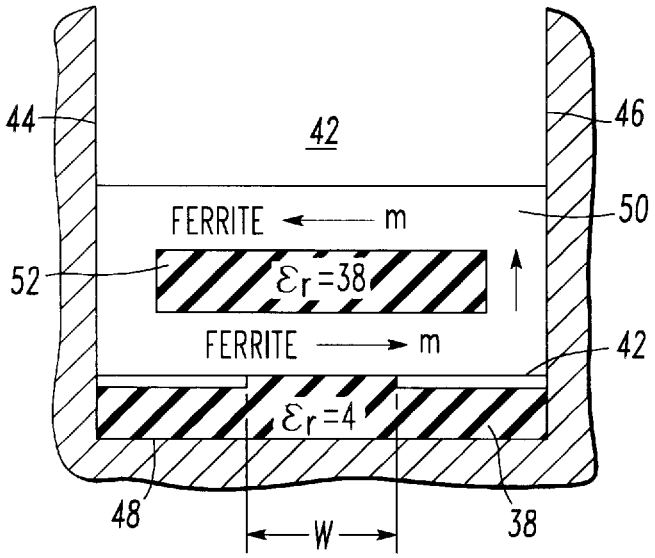
FIGS. 5A and 5B are transverse cross sections generally illustrative of a planar ferrite toroid microwave phase shifter in accordance with the subject invention.
Figure 5B:
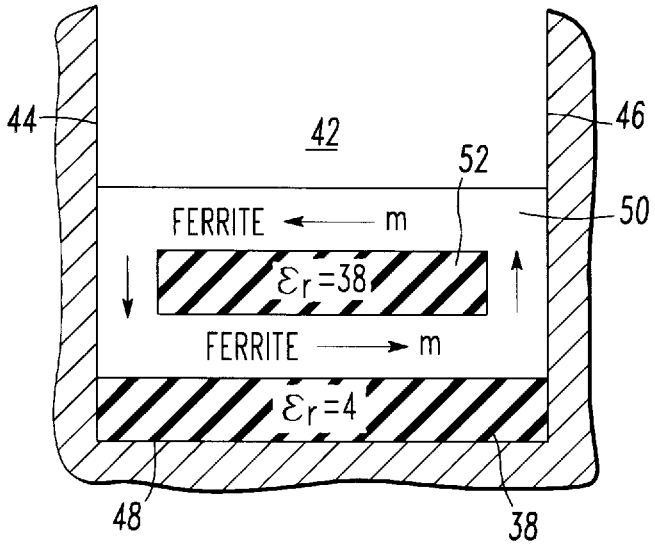

FIGS. 5A and 5B, however, disclose a latchable ferrite phase shifter device and one broadly illustrative of the inventive concept of the subject invention. The phase shifter shown comprises a solid ferrite element 50 which forms a closed ferrite loop and is essentially a flattened toroid having an inner region 52 of generally rectangular cross section filled with dielectric material having a relatively high dielectric constant ($\epsilon r$=38). In all other respects, it is similar to the structure shown in 4B, where the members 50 and 52 are located above a layer 42 of slot line and a layer 38 of dielectric material having a relatively low dielectric constant ($\epsilon r$=4) and being formed over a ground plane 48. The structure in FIG. 5B is identical to that of FIG. 5A, with the exception that the slot line 42 is deleted so that the lower portion of the ferrite toroid 50 is now contiguous with the lower layer of dielectric material 38.

Figure 2:
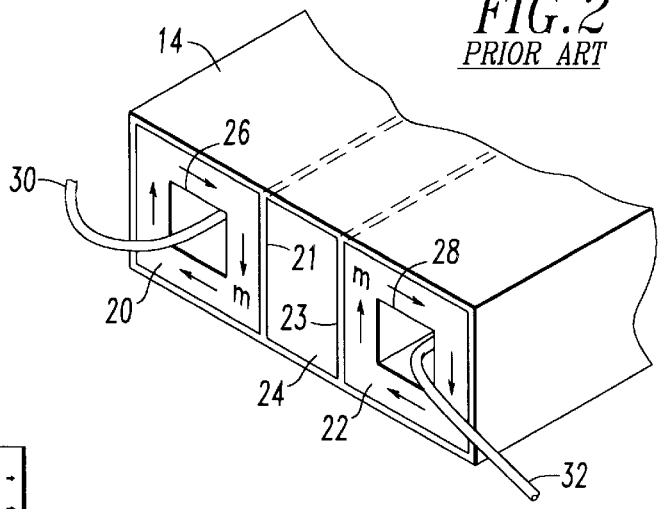
FIG. 2 PRIOR ART
FIG. 2 is a partial perspective view generally illustrative of a twin toroid phase shifter in accordance with the known prior art.
Figure 3:
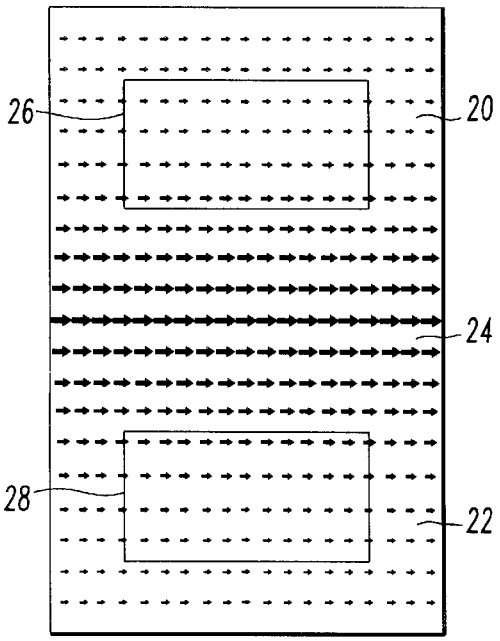
FIG. 3 is a diagram illustrative of the E-field distribution in a twin toroid structure such as shown in FIG. 2, but rotated 90°.
Figure 6A:
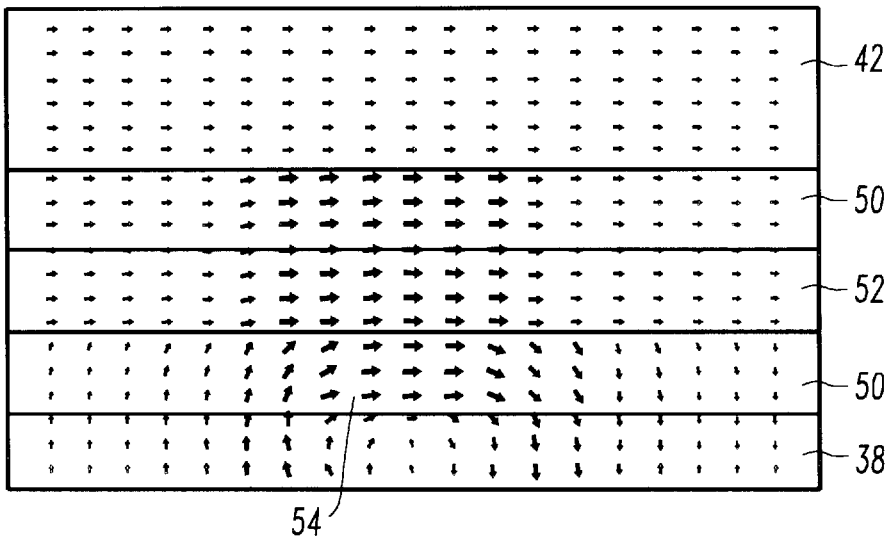
FIGS. 6A and 6B are diagrams illustrative of the E-field distribution in the phase shifter shown in FIGS. 5A and 5B, respectively.
Figure 6B:
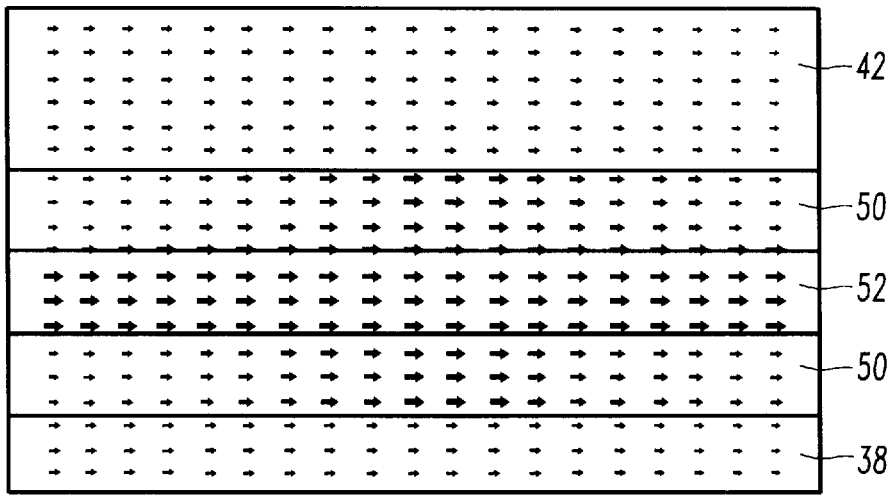

FIGS. 6A and 6B depict the RF field distribution transversely across the respective regions of the phase shifter structures shown in FIGS. 5A and SB. It can be seen that the magnetization of the layer 42 of slot line affects the field distribution as shown in the region denoted by reference numeral 54. The field distribution depicted in FIG. 6B is similar to that shown in the upper half of FIG. 3, which depicts the RF field distribution in the dual toroid structure shown in FIG. 2 when rotated 90°. It should be noted that the phase shift per unit length of the structures shown in FIGS. 4A, 4B and 5A, SB increases with frequency. For example, at 12 GHz, the structure as shown in FIG. 4A can provide a typical phase shift of 46.6°/cm., while at 16 GHz the phase shift is 66.2°/cm., the wider slot configuration shown in FIG. 4B typically can produce phase shifts of 97.1°/cm. and 98.1°/cm. at the same frequencies. Likewise, with respect to the two structures shown in FIGS. 5A and 5B, at 12 GHz, the configuration of FIG. 5A typically can provide a phase shift of 174.2°/cm. at 12 GHz and 178.20 at 16 GHz., while the configuration without the slot line (FIG. 5B) can provide the highest phase shift, typically 220.4°/cm. and 203.2°/cm.

Figure 7:
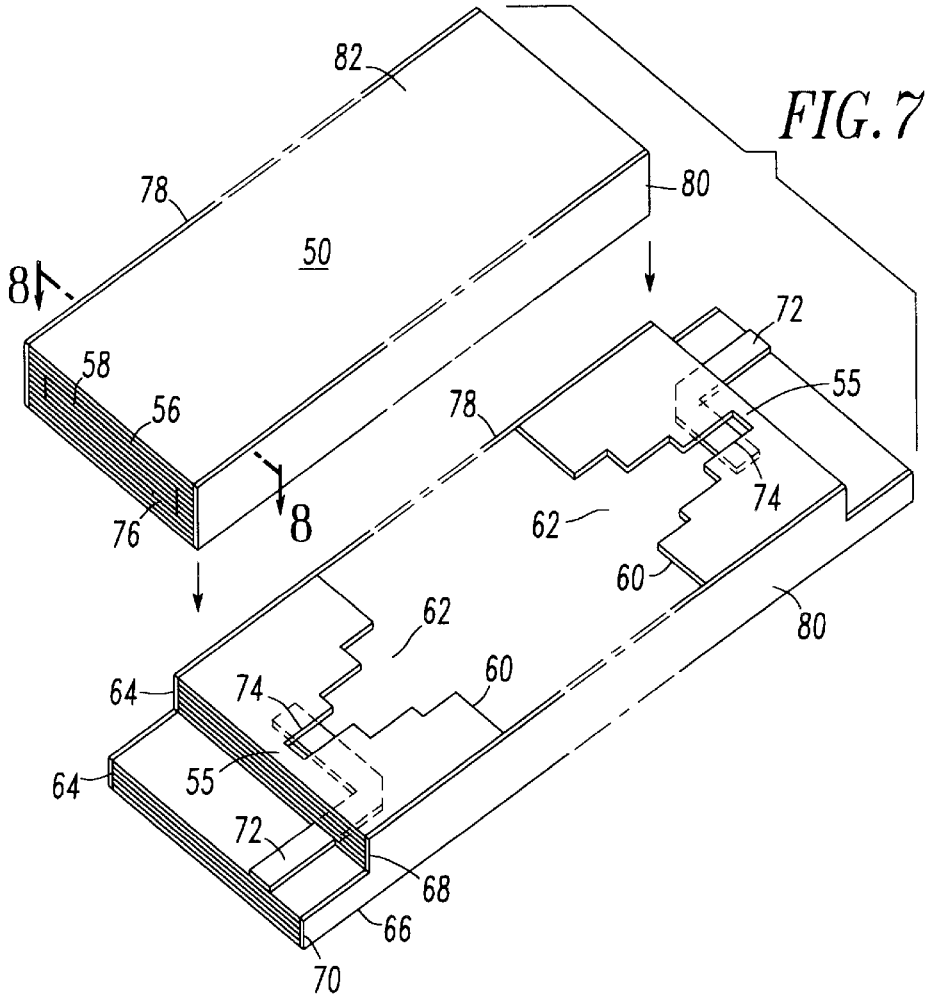
FIG. 7 is an exploded perspective view illustrative of the preferred embodiment of the invention.
Figure 8:
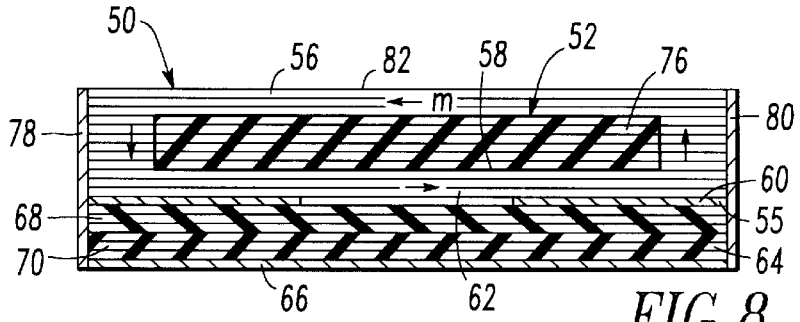
FIG. 8 is a transverse cross sectional view of the embodiment shown in FIG. 7 taken along the lines 8—8 thereof.
Figure 9:
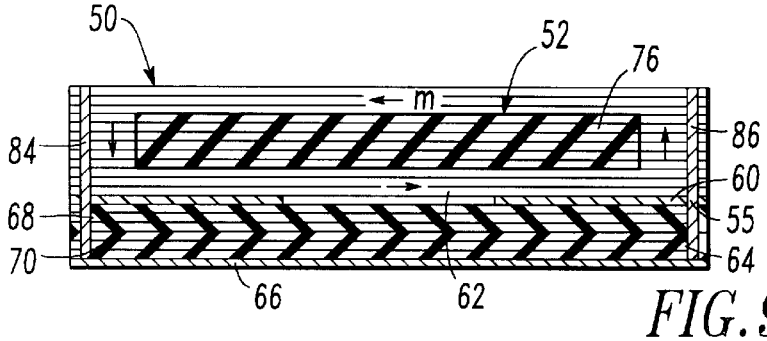
FIG. 9 is a transverse cross sectional diagram of a modification of the structure shown in FIG. 8.

Referring now to the preferred embodiments of the subject invention, reference is now made to FIGS. 7–9. FIGS. 7 and 8, for example, are illustrative of a planar ferrite phase shifter which is effectively a flattened single toroid spaced above a ground plane, and as shown in FIG. 7, also includes a stripline to slot line transition 55 and vice versa at the ends of the device. The embodiments comprise laminated structures which are fabricated using low temperature cofired ceramic (LTCC) and tape cast techniques. The structure comprises multiple layers of lithium ferrite tape 56, typically 0.02 in. total thickness, and multiple layers of relatively high dielectric constant ($\epsilon r$=38) dielectric material 58, layer 60 of a slot line transmission line including stepped notch region 62 forming the transition 55, and multiple layers of underlying low dielectric constant dielectric material 64, all formed on a ground plane 66.

The ferrite layers 56, moreover, are configured in the form of a toroid 50 as shown in FIGS. 5A and 5B encircling a region 52 of dielectric material having a high dielectric constant. The layers of relatively low dielectric constant dielectric material 64 include an upper section 68 and a lower section 70, as shown in FIG. 7, so as to provide a surface for connecting to an angulated section of stripline transmission line 72 which traverses under and across the outer end portion 74 of the slot line transitional layer 60. Such a configuration is ideally suited for modern phased array antennas which are currently being designed around stripline manifolds and strip-fed radiators rather than waveguide. A single metallized conductor 76 is formed on one of the ferrite layers 56 of the toroid 50 for carrying a pulse of current utilized for magnetizing the ferrite. When assembled, the ferrite and dielectric layers are all cofired so as to form an integrated structure.

Further as shown in FIGS. 7 and 8, the structure also includes metallized side surfaces 78 and 80. The top surface 82 can either be metallized or left open. In the embodiment shown in FIG. 7, it is left open to provide an air space similar to that shown by reference numeral 42 in FIGS. 5A and 5B. RF shielding requirements, not phase performance, will determine whether the top surface 82 is metallized or left open.

The embodiment shown in FIG. 9 is a variation of the embodiment shown in FIGS. 7 and 8 in that the metallized sidewalls 78 and 80 are now replaced by sets of spaced vias 84 and 86, which pass through the various ferrite and dielectric layers 56 and 64 to the ground plane 66.

The embodiments of the invention shown and described herein can be designed to provide a differential phase shift of over 200°/cm. in the Ku-band. A typical requirement of 400°/cm. phase shift will require a planar stripline phase shifter as shown in FIG. 7, to be at least 2 in. long. The thickness of each layer and the dielectric constants can be varied to achieve operation over a given frequency range. The RF fields in the embodiments of the subject invention typically as shown in FIGS. 6A and 6B, as a signal travels, for example, from an input end at the left through the device and exits at an output end to the right of the structure shown in FIG. 7.

Since the whole structure is planar, the modern low-cost tape-casting method of making ferrites is ideal for this type of fabrication and the entire structure including the stripline feed, slot line fins and magnetizing conductor can be fired in final form in one step. Large numbers of devices can be formed on a single sheet, in the manner of integrated circuits. In certain instances, it may be necessary to use barrier layers between the different materials to prevent iron in the ferrite from diffusing into the dielectric, although it is not certain that iron diffusion would necessarily harm RF performance.

Thus what has been shown and described is a planar approach to fabricating a non-reciprocal ferrite phase shifter wherein alternating layers of ferrite and dielectric, fabricated using low temperature cofired ceramic technology, are built up to produce a planar latching ferrite phase shifter which is comparable to a waveguide toroidal structure, but achieved at a much lower cost than heretofore.

Having thus shown and described what is at present considered to be the preferred embodiments of the invention, it should be noted that the same is made by way of illustration and not limitation. Accordingly, all alterations, modifications and changes coming within the spirit and scope of the invention as set forth in the appended claims are herein meant to be included.

I claim:

1. A planar ferrite toroid phase shifter, comprising:

an elongated ground plane having a predetermined length;

a plurality of elongated planar layers of dielectric material having a first dielectric constant formed in upper and lower sections of planar layers on said ground plane, said lower section of planar layers being coextensive with said ground plane;

a plurality of planar layers of ferrite material formed in an elongated toroid on said layers of first dielectric constant and being coextensive with said upper section of elongated planar layers of dielectric material, said toroid having a centralized internal space extending the length thereof;

a plurality of elongated planar layers of dielectric material having a second dielectric constant formed in and coextensive with said centralized internal space of the toroid; and, an electrical conductor element located in and coextensive with said toroid in said centralized internal space of said toroid for magnetizing the layers of ferrite material forming said toroid so as to provide a latched operating state of the phase shifter.

2. A phase shifter according to claim 1 wherein said plurality of layers of dielectric material of said first and said second dielectric constant and said plurality of layers of ferrite material are comprised of materials which can be cofired using low temperature cofired ceramic and tape cast techniques to form an integrated structure.

3. A phase shifter according to claim 1 wherein said first dielectric constant comprises a relatively low dielectric constant and said second dielectric constant comprises a relatively high dielectric constant.

4. A phase shifter according to claim 1 wherein said relatively low dielectric constant is about 4 and said relatively high dielectric constant is about 38.

5. A phase shifter according to claim 1 wherein said toroid comprises a flattened toroid having a first dimension which is greater than a second dimension which is transverse to said first dimension.

6. A phase shifter according to claim 1 wherein said toroid is generally rectangular in cross section and having a width dimension extending parallel to said ground plane which is greater than a thickness dimension which is orthogonal to said ground plane.

7. A phase shifter according to claim 1 and further including metallized side walls extending to and contacting said ground plane.

8. A phase shifter according to claim 1 and further including metal vias extending through an outer portion of said toroid adjacent side walls thereof, said vias extending to and contacting said ground plane.

9. A phase shifter according to claim 1 wherein a top surface of said toroid is exposed to air.

10. A phase shifter according to claim 1 and further including at least one microwave transition located at one end of the phase shifter intermediate said plurality of planar layers of dielectric material of said first dielectric constant and said plurality of planar layers of ferrite material for coupling energy to or from the phase shifter.

11. A phase shifter according to claim 10 wherein said transition is located at an input end of the phase shifter.

12. A phase shifter according to claim 11 and additionally including a transition located at an output end of the phase shifter.

13. A phase shifter according to claim 10 wherein said transition includes a section of slot line microwave transmission line contiguous to a lower surface region of said toroid.

14. A phase shifter according to claim 13 wherein said section of slot line includes a flat layer of metallization in the form of a fin having a notched region of varying width.

15. A phase shifter according to claim 14 wherein said notched region comprises a stepped notched region.

16. A phase shifter according to claim 10 wherein said transition comprises a stripline to slot line transition.

17. A phase shifter according to claim 16 wherein said stripline to slot line transition includes a section of stripline microwave transmission line located between said upper and lower sections of said plurality of layers of said dielectric material of first dielectric constant coupled to a section of slot line microwave transmission line located on an uppermost layer of said upper section of layers of dielectric material of first dielectric constant and adjacent a lowermost layer of said plurality of layers of ferrite material forming said toroid.

18. A phase shifter according to claim 17 wherein said section of slot line transmission line includes a layer of metallization having a notch varying in width from a relatively small outer end to a relatively wide inner end and wherein said section of stripline includes a length of transmission coupled to the outer end of said notch.

19. A phase shifter according to claim 18 wherein said lower section of said layers of said first dielectric constant extends beyond said upper section of said layers of said first dielectric constant on said ground plane so as to expose an upper surface portion of said section of stripline on the lower section of layers of first dielectric constant at the outer end thereof for coupling microwave energy to or from said toroid.

20. A phase shifter according to claim 10 wherein said plurality of layers of dielectric material of said first and said second dielectric constant, said plurality of layers of ferrite, and said at least one microwave transition include materials which are cofired to form an integrated planar structure.

* * * * *